US012378894B1

(12) United States Patent
Bisson et al.

(10) Patent No.: US 12,378,894 B1
(45) Date of Patent: Aug. 5, 2025

(54) CONTAINMENT RING FOR GAS TURBINE ENGINE

(71) Applicant: Pratt & Whitney Canada Corp., Longueuil (CA)

(72) Inventors: Jocelyn Bisson, Saint-Basile-le-Grand (CA); Guy Lefebvre, St-Bruno (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 18/426,009

(22) Filed: Jan. 29, 2024

(51) Int. Cl.

| | |
|---|---|
| ***F01D 11/12*** | (2006.01) |
| ***F01D 9/04*** | (2006.01) |
| ***F01D 21/04*** | (2006.01) |
| ***F01D 25/24*** | (2006.01) |

(52) U.S. Cl.
CPC ..... *F01D 11/127* (2013.01); *F01D 9/04* (2013.01); *F01D 21/045* (2013.01); *F01D 25/246* (2013.01)

(58) Field of Classification Search
CPC ..... F01D 9/04; F01D 11/127; F01D 21/045; F01D 25/26
See application file for complete search history.

(56) References Cited

U.S. PATENT DOCUMENTS

| | | | | |
|---|---|---|---|---|
| 1,166,820 A | | 1/1916 | Doherty | |
| 4,639,188 A | | 1/1987 | Swadley | |
| 5,259,724 A | | 11/1993 | Liston et al. | |
| 5,328,324 A | * | 7/1994 | Dodd | F01D 21/045 415/9 |
| 5,516,258 A | * | 5/1996 | Newton | F01D 21/045 415/200 |
| 6,059,523 A | * | 5/2000 | Modafferi | F01D 21/045 415/196 |
| 6,206,631 B1 | | 3/2001 | Schilling | |
| 6,575,694 B1 | * | 6/2003 | Thompson | F01D 21/045 415/200 |
| 6,637,186 B1 | | 10/2003 | Van Duyn | |
| 7,874,136 B2 | | 1/2011 | Heyerman | |
| 9,677,570 B2 | * | 6/2017 | Care | F04D 19/002 |
| 10,533,450 B2 | | 1/2020 | Kling et al. | |
| 10,731,662 B2 | | 8/2020 | Crutchfield | |
| 11,008,887 B2 | | 5/2021 | Hall et al. | |
| 11,015,482 B2 | | 5/2021 | Kasal et al. | |
| 11,549,442 B2 | | 1/2023 | Asdev et al. | |

(Continued)

FOREIGN PATENT DOCUMENTS

| | | |
|---|---|---|
| EP | 1073828 A1 | 2/2001 |
| EP | 3090148 B1 | 5/2021 |
| FR | 3004215 A1 | 10/2014 |

OTHER PUBLICATIONS

Search Report issued in European Patent Application No. 25154761.8; Date of Mailing Jun. 3, 2025 (7 pages).

*Primary Examiner* — Christopher R Legendre
(74) *Attorney, Agent, or Firm* — CANTOR COLBURN LLP

(57) ABSTRACT

A containment ring assembly for a turbine casing assembly, including: a first containment ring; a second containment ring, the first containment ring being radially inward from the second containment ring, wherein a radial space is located between the first containment ring and the second containment ring, the radial space allowing deformation of the first containment ring prior to the first containment ring contacting the second containment ring.

16 Claims, 7 Drawing Sheets

(56) References Cited

U.S. PATENT DOCUMENTS

| | | | |
|---|---|---|---|
| 11,668,205 | B2 | 6/2023 | Guymon et al. |
| 11,698,001 | B2 | 7/2023 | Kasal et al. |
| 11,821,326 | B2 | 11/2023 | Vanapalli et al. |
| 2016/0273380 | A1 | 9/2016 | Stiehler et al. |
| 2016/0341075 | A1 | 11/2016 | Liu et al. |
| 2017/0198604 | A1 | 7/2017 | Lefebvre et al. |
| 2020/0165936 | A1 | 5/2020 | Kasal et al. |
| 2020/0200038 | A1 | 6/2020 | Hall et al. |
| 2021/0301728 | A1 | 9/2021 | Nayak et al. |
| 2022/0251969 | A1* | 8/2022 | Guymon ..... F01D 21/045 |

* cited by examiner

CONTAINMENT RING FOR GAS TURBINE ENGINE

BACKGROUND

This disclosure relates to structures for use in gas turbine engines, and more particularly to a containment ring for use in a gas turbine engine.

Gas turbine engines have a turbine casing assembly. The turbine casing assembly may include a containment ring. It is desirable to decrease the weight of a containment ring while providing the desired containment.

BRIEF DESCRIPTION

Disclosed is a containment ring assembly for a turbine casing assembly, including: a first containment ring; a second containment ring, the first containment ring being radially inward from the second containment ring, wherein a radial space is located between the first containment ring and the second containment ring, the radial space allowing deformation of the first containment ring prior to the first containment ring contacting the second containment ring.

In addition to one or more of the features described above, or as an alternative to any of the foregoing embodiments, the first containment ring and the second containment ring are formed from two different types of material.

In addition to one or more of the features described above, or as an alternative to any of the foregoing embodiments, the first containment ring is formed from a more ductile material than the second containment ring.

In addition to one or more of the features described above, or as an alternative to any of the foregoing embodiments, the first containment ring has a main body portion, the main body portion of the first containment ring having a forward end and an aft end, an outer periphery, and an inner periphery and the second containment ring has a main body portion, the main body portion of the second containment ring having a forward end and an aft end, an outer periphery, and an inner periphery, and the radial space being located between the outer periphery of the first containment ring and the inner periphery of the second containment ring.

In addition to one or more of the features described above, or as an alternative to any of the foregoing embodiments, the main body portion of the first containment ring has a first stage containment zone and a second stage containment zone, the first stage containment zone comprising a ring of material coupled to a ring of material comprising the second stage containment zone by a plurality of tabs, the plurality of tabs being separated from each other by a plurality of slotted openings and the plurality of slotted openings being in fluid communication with an annular groove that extends from the outer periphery of the main body portion of the first containment ring, and the main body portion of the second containment ring has a first stage containment zone and a second stage containment zone, the first stage containment zone comprising a ring of material coupled to a ring of material comprising the second stage containment zone by a plurality of tabs, the plurality of tabs being separated from each other by a plurality of slotted openings and the plurality of slotted openings being in fluid communication with an annular groove that extends from the inner periphery of the main body portion of the second containment ring.

In addition to one or more of the features described above, or as an alternative to any of the foregoing embodiments, the containment ring further including a flange portion secured to the aft end of the main body portion of the first containment ring or the aft end of the main body portion of the second containment ring.

In addition to one or more of the features described above, or as an alternative to any of the foregoing embodiments, the forward end of the main body portion of the first containment ring is secured to the forward end of the main body portion of the second containment ring.

In addition to one or more of the features described above, or as an alternative to any of the foregoing embodiments, the flange portion is secured to the aft end of the main body portion of the first containment ring or the aft end of the main body portion of the second containment ring by a plurality of tabs.

In addition to one or more of the features described above, or as an alternative to any of the foregoing embodiments, the first containment ring and the second containment ring are formed from two different types of material.

In addition to one or more of the features described above, or as an alternative to any of the foregoing embodiments, the first containment ring is formed from a more ductile material than the second containment ring.

Also disclosed is a turbine casing assembly, including: an outer structural case; and a containment ring, including: a first containment ring; a second containment ring, the first containment ring being radially inward from the second containment ring, wherein a radial space is located between the first containment ring and the second containment ring, the radial space allowing deformation of the first containment ring prior to the first containment ring contacting the second containment ring.

In addition to one or more of the features described above, or as an alternative to any of the foregoing embodiments, the first containment ring and the second containment ring are formed from two different types of material.

In addition to one or more of the features described above, or as an alternative to any of the foregoing embodiments, the first containment ring is formed from a more ductile material than the second containment ring.

In addition to one or more of the features described above, or as an alternative to any of the foregoing embodiments, the first containment ring has a main body portion, the main body portion of the first containment ring having a forward end and an aft end, an outer periphery, and an inner periphery and the second containment ring has a main body portion, the main body portion of the second containment ring having a forward end and an aft end, an outer periphery, and an inner periphery, and the radial space being located between the outer periphery of the first containment ring and the inner periphery of the second containment ring.

In addition to one or more of the features described above, or as an alternative to any of the foregoing embodiments, the main body portion of the first containment ring has a first stage containment zone and a second stage containment zone, the first stage containment zone comprising a ring of material coupled to a ring of material comprising the second stage containment zone by a plurality of tabs, the plurality of tabs being separated from each other by a plurality of slotted openings and the plurality of slotted openings being in fluid communication with an annular groove that extends from the outer periphery of the main body portion of the first containment ring, and wherein the main body portion of the second containment ring has a first stage containment zone and a second stage containment zone, the first stage containment zone comprising a ring of material coupled to a ring of material comprising the second stage containment zone by a plurality of tabs, the plurality of tabs being separated from each other by a plurality of slotted openings and the plurality of slotted openings being in fluid communication with an annular groove that extends from the inner periphery of the main body portion of the second containment ring.

In addition to one or more of the features described above, or as an alternative to any of the foregoing embodiments, the containment ring further including a flange portion secured to the aft end of the main body portion of the first containment ring or the aft end of the main body portion of the second containment ring, the flange portion being secured to the outer structural case.

In addition to one or more of the features described above, or as an alternative to any of the foregoing embodiments, the forward end of the main body portion of the first containment ring is secured to the forward end of the main body portion of the second containment ring.

In addition to one or more of the features described above, or as an alternative to any of the foregoing embodiments, the flange portion is secured to the aft end of the main body portion of the first containment ring or the aft end of the main body portion of the second containment ring by a plurality of tabs.

In addition to one or more of the features described above, or as an alternative to any of the foregoing embodiments, the first containment ring and the second containment ring are formed from two different types of material and the first containment ring is formed from a more ductile material than the second containment ring.

Also disclosed is a gas turbine engine, including: a compressor section; a combustor; a turbine section; and a turbine casing assembly, including: an outer structural case; and a containment ring, including: a first containment ring; a second containment ring, the first containment ring being radially inward from the second containment ring, wherein a radial space is located between the first containment ring and the second containment ring, the radial space allowing deformation of the first containment ring prior to the first containment ring contacting the second containment ring.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the FIGS.

Figure 1:
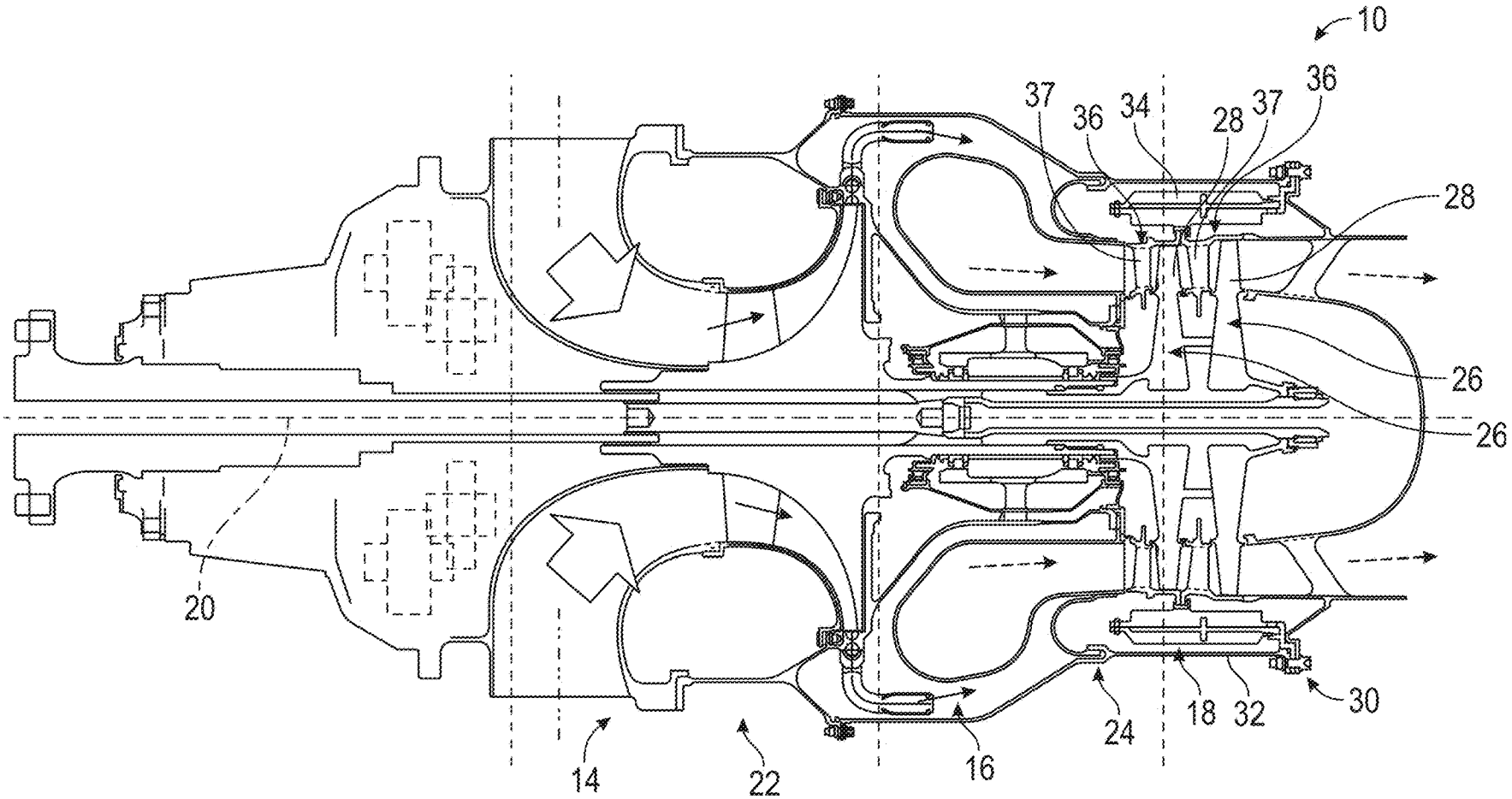
FIG. 1 is a schematic cross-sectional view of a gas turbine engine.

FIG. 1 illustrates a gas turbine engine 10, generally comprising in serial flow communication a compressor section 14 for pressurizing the air, a combustor section 16 in which the compressed air is mixed with fuel and ignited for generating an annular stream of hot combustion gases, and a turbine section 18 for extracting energy from the combustion gases. Some of the rotatable components of the gas turbine engine 10 rotate about a longitudinal center axis 20 of the gas turbine engine 10.

The gas turbine engine 10 has a "cold" section 22 and a "hot" section 24. The cold section 22 includes those components of the gas turbine engine 10 which are upstream (relative to the direction gases flow through the gas turbine engine 10) of the combustor 16 and have thus not been exposed to the hot combustion gases. The hot section 24 includes the combustor 16 and those components of the gas turbine engine 10 which are downstream of the combustor 16. The components of the hot section 24 are thus exposed to the hot combustion gases generated in the combustor 16. The gases flowing through the cold section 22 have a lower temperature than the gases flowing through the hot section 24.

The hot section 24 includes the combustor 16, the turbine section 18 and a case downstream of the turbine section 18 for conveying the exhaust gases. The turbine section 18 includes one or more rotors 26 each having a plurality of rotor blades 28 secured to a hub 29 which rotates about the center axis 20 and extract energy from the combustion gases. In one implementation the turbine blades 28 are integrally formed with the hub 29 in order to form a single component referred to as an integrally bladed rotor or IBR 26. The hot section 24 includes stationary bodies which enclose other components of the hot section 24 and define the gas path for the hot combustion gases. These stationary bodies are sometimes referred to as casings or cases which collectively define radially-outer boundaries of the gas turbine engine.

Referring now to at least FIGS. 1-4, the casing of the gas turbine engine 10 includes a turbine casing assembly 30 which is part of the hot section 24. The turbine casing assembly 30 is a group of casing components that form part of the turbine section 18 and enclose the combustion gases. The turbine casing assembly 30 may be provided as disassembled components which may then be assembled in a suitable facility. The turbine casing assembly 30 includes an outer structural case 32, a containment ring or containment ring assembly 34, and at least one vane ring 36. The at least one vane ring 36 having at least one vane 37 secured thereto. In one embodiment, the at least one vane ring 36 having the at least one vane 37 may be formed as a single component.

In one embodiment, the outer structural case 32, the containment ring or containment ring assembly 34, and the least one vane ring 36 have circular portions or configurations.

The present disclosure is generally directed to a containment ring or containment ring assembly 34 having two radially superposed containment zones where the first layer is dimensioned to absorb the kinetic energy of fragment(s) by plastic deformation and the second layer to contain the fragment(s). This sequence has the effect of improving the confinement of the second containment layer due to the contact zone resulting from the deformation of the first containment ring. The space between the two containment layers and the thickness ratio between the first and second containment rings optimize containment while maintaining a reduced total thickness compared with a singular containment ring.

Figure 2:
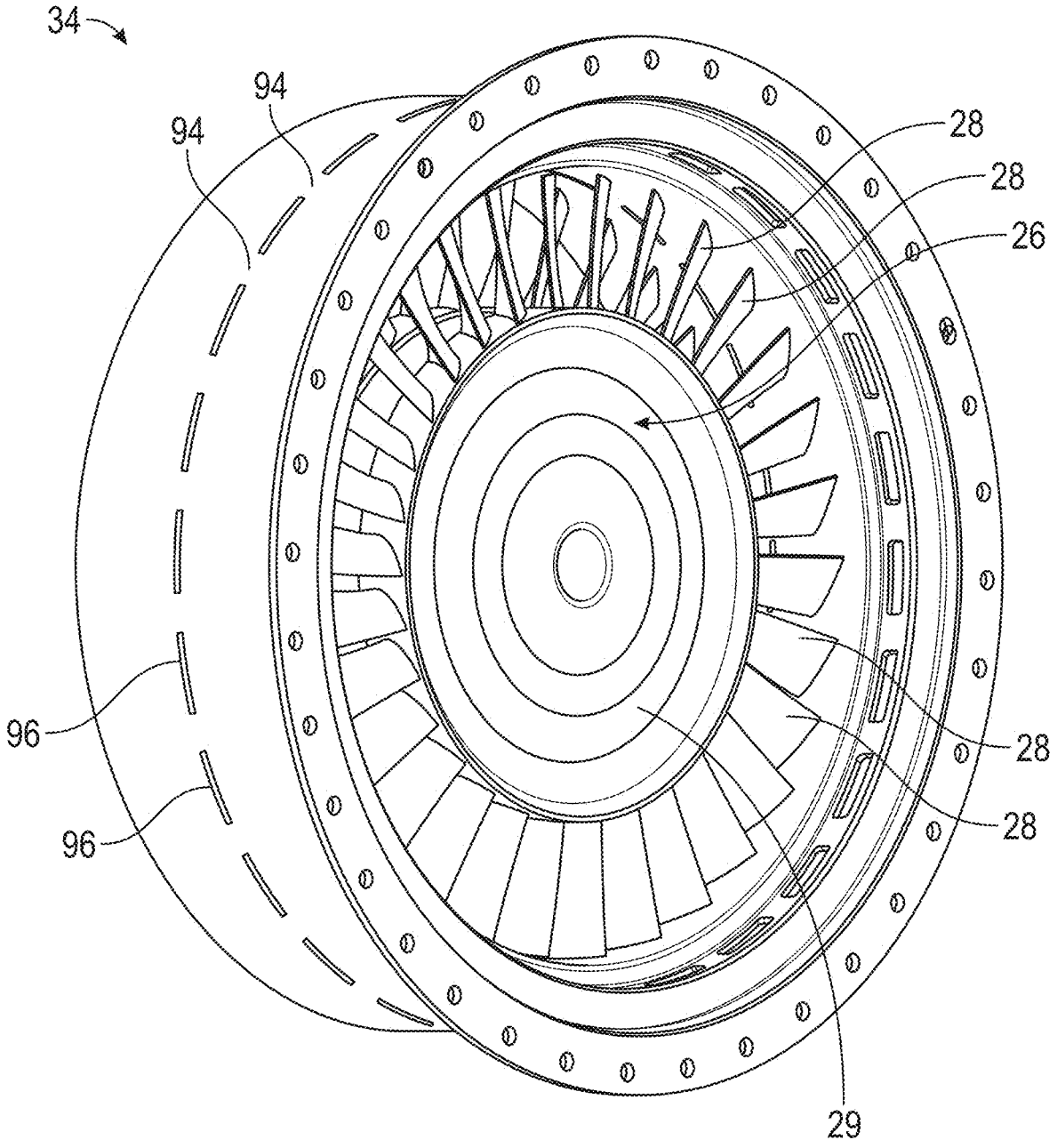
FIG. 2 is a perspective view of a containment ring and rotors in accordance with the present disclosure.
Figure 3:
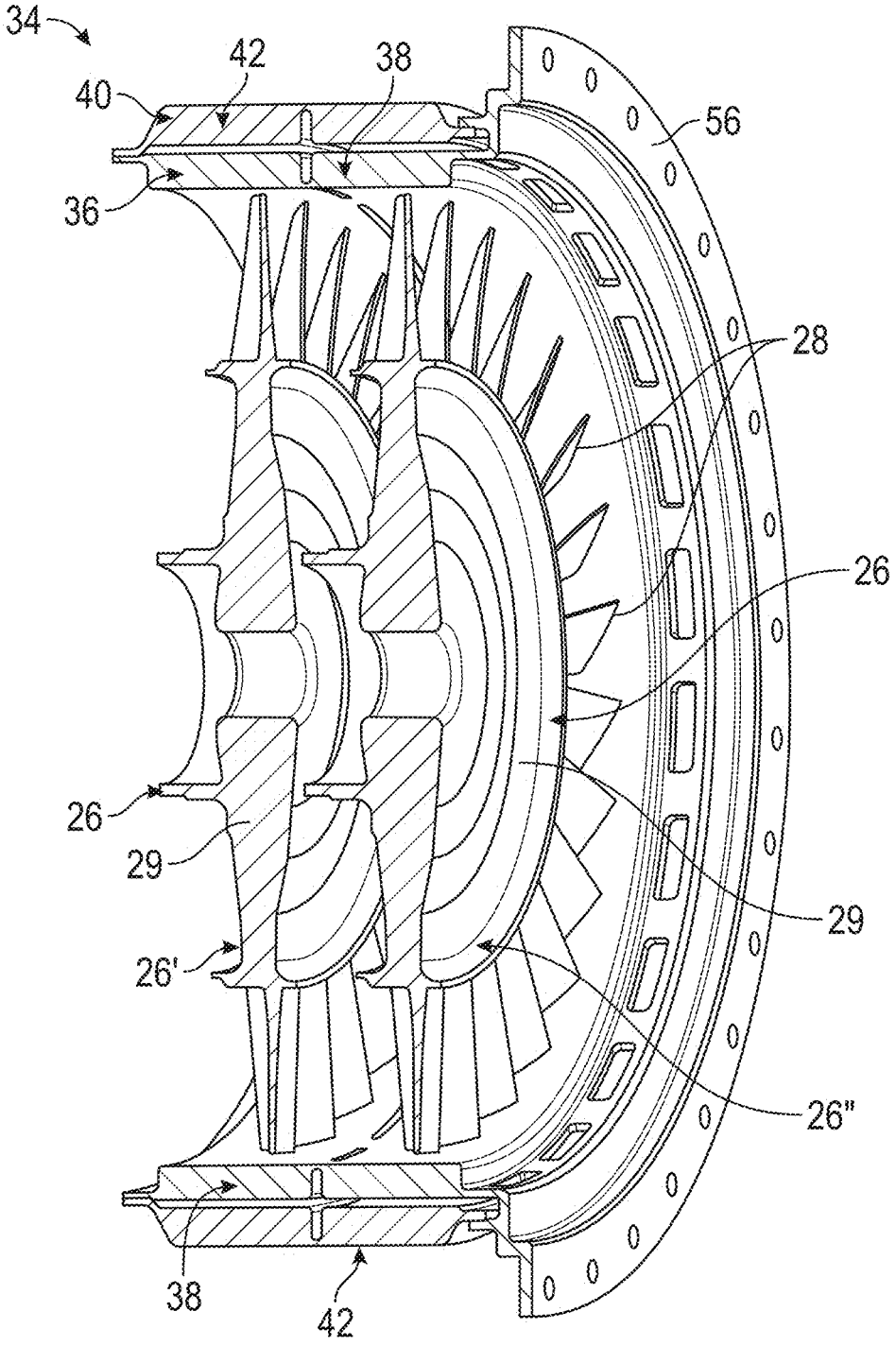
FIG. 3 is a perspective cross-sectional view of the containment ring and rotors illustrated in FIG. 2.
Figure 4:
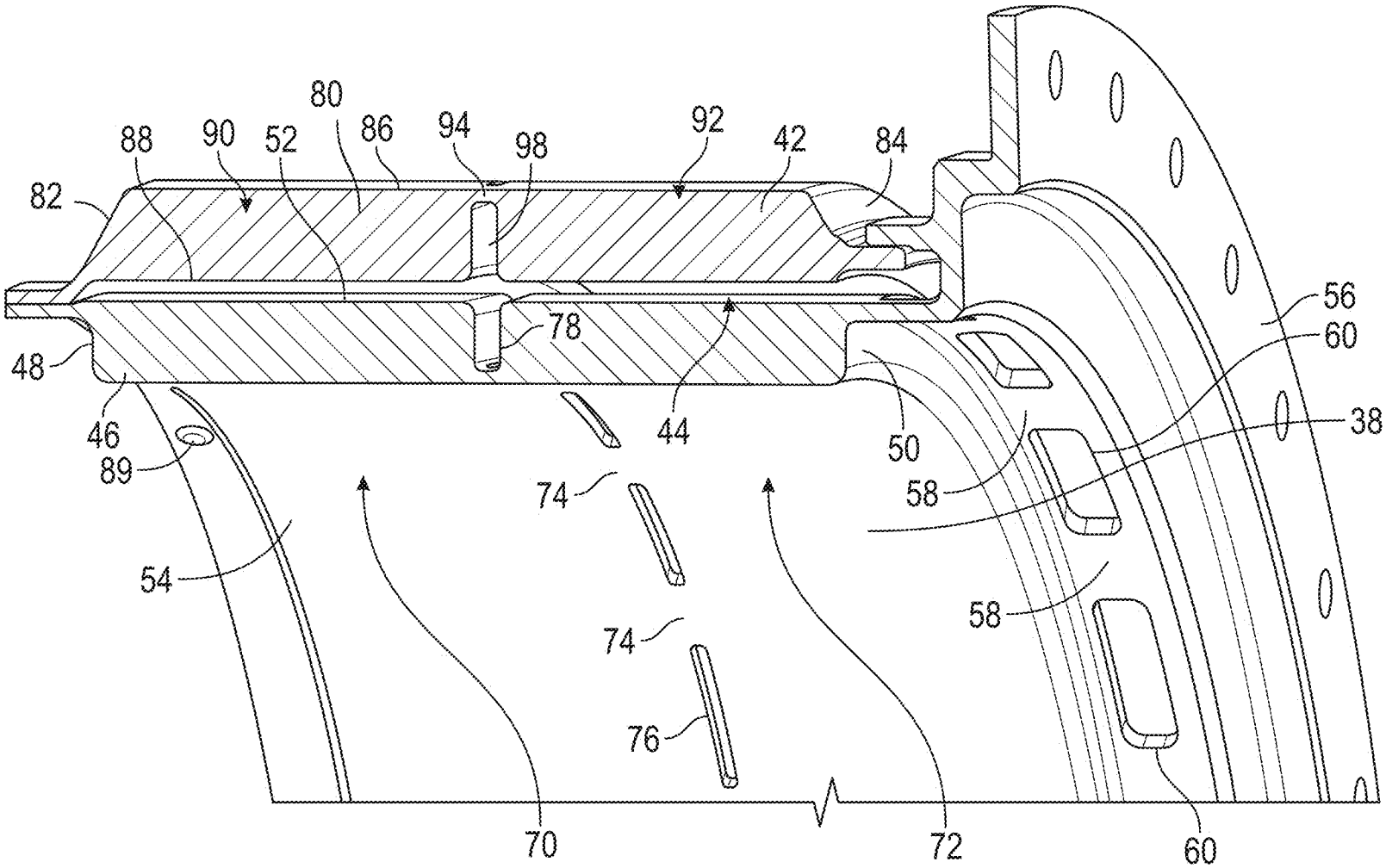
FIG. 4 is an enlarged perspective cross-sectional view of a portion of the containment ring in accordance with the present disclosure.

FIG. 2 is a perspective view of a containment ring or containment ring assembly 34 and a pair of rotors 26 in accordance with the present disclosure and FIG. 3 is a cross-sectional view of the containment ring or containment ring assembly 34 and rotors 26 illustrated in FIG. 2. FIG. 4 is an enlarged perspective cross-sectional view of a portion of the containment ring or containment ring assembly 34 in accordance with the present disclosure.

In accordance with the present disclosure, the containment ring or containment ring assembly 34 has two radially superposed containment zones, defined by a first or inner containment zone 36 comprising a first or inner containment ring 38 and a second or outer containment zone 40 comprising a second or outer containment ring 42. The inner containment ring 38 being configured and dimensioned to absorb the kinetic energy of a fragment by plastic deformation and the second or outer containment ring 42 contains the fragment, which impacts the first or inner containment ring 38 first prior and thereafter the impact force is applied to the second or outer containment ring 42 and the fragment is retained by the second or outer containment ring 42. This sequence has the effect of improving the confinement of the second or outer containment zone 40 comprising the second or outer containment ring 42 due to the contact zone resulting from the deformation of the first containment ring or inner containment ring 38. A radial space 44 is located between the two containment rings 38 and 42 and a thickness ratio between the first and second containment rings 38, 42 optimizes containment of the containment ring or containment ring assembly 34 while maintaining a reduced total thickness compared with a singular containment ring.

The radial space 44 allows the first containment ring or inner containment ring 38 to deform freely with regard to the second containment ring or outer containment ring 42. In other words, the radial space 44 allowing deformation of the first containment or inner containment ring 38 prior to the first or inner containment ring 38 contacting the second or outer containment ring 42 during a containment event (e.g., the containment ring or containment ring assembly 34 retaining or containing a fragment). In accordance with the present disclosure, the thickness of the containment rings 38, 42 can be adapted depending upon the rotor 26 geometry and speed. In addition, the containment rings 38, 42 can be made of two different types of material. For example, the first or inner containment ring 38 may be formed from a more ductile material than the second or outer containment ring 42.

Referring now to at least FIGS. 1-4, the first or inner containment ring 38 has a main body portion 46. The main body portion 46 has a forward end 48 and an aft end 50, an outer periphery 52, and an inner periphery 54. As used herein, the outer periphery 52 is radially outward from the inner periphery 54. In addition, and when the first or inner containment ring 38 is installed in the engine 10, the outer periphery 52 is radially further from the central axis 20 than the inner periphery 54. In addition and as used herein, the forward end 48 is closer to the combustor section 16 than the aft end 50 when the containment ring or containment ring assembly 34 is secured to the engine 10.

The first or inner containment ring 38 also has a flange portion 56 secured thereto. The flange portion 56 is configured to secure the first or inner containment ring 38 to the outer structural case 32. The flange portion 56 being secured to the main body portion 46 via a plurality of tabs 58. In one embodiment, the tabs 58 are separated from each other by a plurality of openings 60. In one embodiment, the tabs 58 are configured to be frangible when the first or inner containment ring 38 is impacted with disc fragments during a fracture event. Still further and in one non-limiting embodiment, the tabs 58 are integrally formed with the first or inner containment ring 38 and the flange portion 56 so that they form a single unitary structure. In one non-limiting embodiment, the containment rings 38, 42 and/or the flange portion 56 may be formed from nickel based alloys or any other suitable material.

In addition, the main body portion 46 of the first or inner containment ring 38 has a first stage containment zone 70 and a second stage containment zone 72. The first stage containment zone 70 comprising a ring of material coupled to a ring of material comprising the second stage containment zone 72 by a plurality of tabs 74. The plurality of tabs 74 being separated from each other by a plurality of slotted openings 76. The plurality of slotted openings 76 being in fluid communication with a longitudinal or annular groove 78 that extends from the outer periphery 52 of the main body portion 46 of the first or inner containment ring 38. In one embodiment, the tabs 74 are configured to be frangible when the first or inner containment ring 38 is impacted with disc fragments during a fracture event. Still further and in one non-limiting embodiment, the tabs 74 are integrally formed with the first or inner containment ring 38 so that they form a single unitary structure.

When the containment ring or containment ring assembly 34 is secured to the engine 10, the first stage containment zone 70 corresponds to a first stage rotor 26' and the second stage containment zone 72 corresponds to a second stage rotor 26".

The second or outer containment ring 42 also has a main body portion 80. The main body portion 80 has a forward end 82 and an aft end 84, an outer periphery 86, and an inner periphery 88. As used herein, the outer periphery 86 is radially outward from the inner periphery 88. In addition, and when the second or outer containment ring 42 is installed in the engine 10, the outer periphery 86 is radially further from the central axis 20 than the inner periphery 88. In addition and as used herein, the forward end 82 is closer to the combustor section 16 than the aft end 84 when the containment ring or containment ring assembly 34 is secured to the engine 10.

In one non-limiting embodiment, the aft end 84 is secured to the flange portion 56. In addition, and in one non-limiting embodiment, the forward end 82 is secured to the forward end 48. In one non-limiting embodiment, the securement of the respective forward ends 48 and 82 is achieved by rivets 89 or any other suitable means e.g. welding or equivalents thereof provide to a tight fit. In addition and in one non-limiting embodiment, the securement of the respective aft end 84 to the flange 56 is achieved by rivets or any other suitable means e.g. welding or equivalents thereof to provide a tight fit. These connections or tight fits will improve the dynamic response of the inner and outer rings 38 and 42 with respect to each other. Alternatively, the respective aft ends 50 and 84 are secured to each other as long as the appropriate radial gap 44 is maintained between the inner and outer rings 38 and 42.

In addition, the main body portion 80 of the second or outer containment ring 42 has a first stage containment zone 90 and a second stage containment zone 92. The first stage containment zone 90 comprising a ring of material coupled to a ring of material comprising the second stage containment zone 92 by a plurality of tabs 94. The plurality of tabs 94 being separated from each other by a plurality of slotted openings 96. The plurality of slotted openings 96 being in fluid communication with a longitudinal or annular groove 98 that extends from the inner periphery 88 of the main body portion 80 of the second or outer containment ring 42. In one non-limiting embodiment, the longitudinal or annular groove 98 of the the second or outer containment ring 42 is aligned with the longitudinal or annular groove 78 of the first or inner containment ring 38 when the second or outer containment ring 42 is secured to the first or inner containment ring 38. In an alternative embodiment, the grooves 78 and 98 are not aligned. In one embodiment, the tabs 94 are configured to be frangible when the first or inner containment ring 38 is impacted with disc fragments during a fracture event. Still further and in one non-limiting embodiment, the tabs 94 are integrally formed with the second or outer containment ring 38 so that they form a single unitary structure.

When the containment ring or containment ring assembly 34 is secured to the engine 10, the first stage containment zone 90 corresponds to the first stage rotor 26' and the second stage containment zone 92 corresponds to the second stage rotor 26". In other words, the first stage containment zone 70 of the first or inner containment ring 38 and the first stage containment zone 90 of the second or outer containment ring 42 are aligned for containment of the first stage rotor 26' and the second stage containment zone 72 of the first or inner containment ring 38 and the second stage containment zone 92 of the second or outer containment ring 42 are aligned for containment of the first stage rotor 26", wherein the tabs 74 and 94, openings 76 and 96 and grooves 78 and 98 allow for respective displacement of the respective containment zones 70, 90 and 72, 92 depending one which rotor or rotors 26' 26" require containment.

While the FIGS. illustrate the first or inner containment ring 38 having a first stage containment zone 70 and a second stage containment zone 72 and the second or outer containment ring 42 has a first stage containment zone 90 and a second stage containment zone 92, it is understood that in an alternative embodiment of the present disclosure the first or inner containment ring 38 has only a single stage containment zone extending between the forward and aft portions and the second or outer containment ring 42 only has a single stage containment zone 90 and extending between the forward and aft portions. Here the single stage containment zones 70 and 90 are radially separated from each other by gap 44.

Figure 4A:
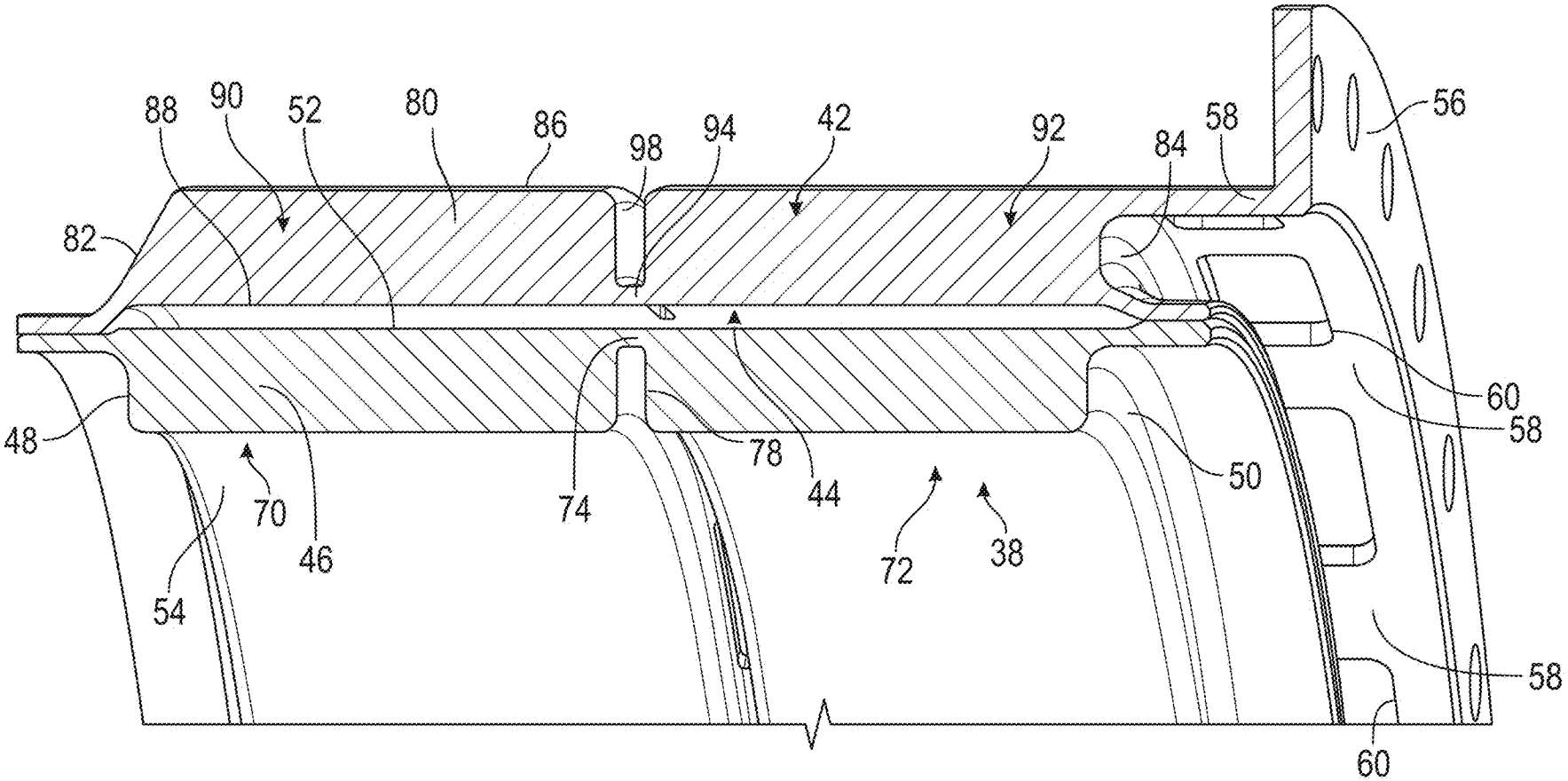
FIG. 4A is an enlarged perspective cross-sectional view of a portion of the containment ring in accordance with an alternative embodiment of the present disclosure.
Figure 4B:
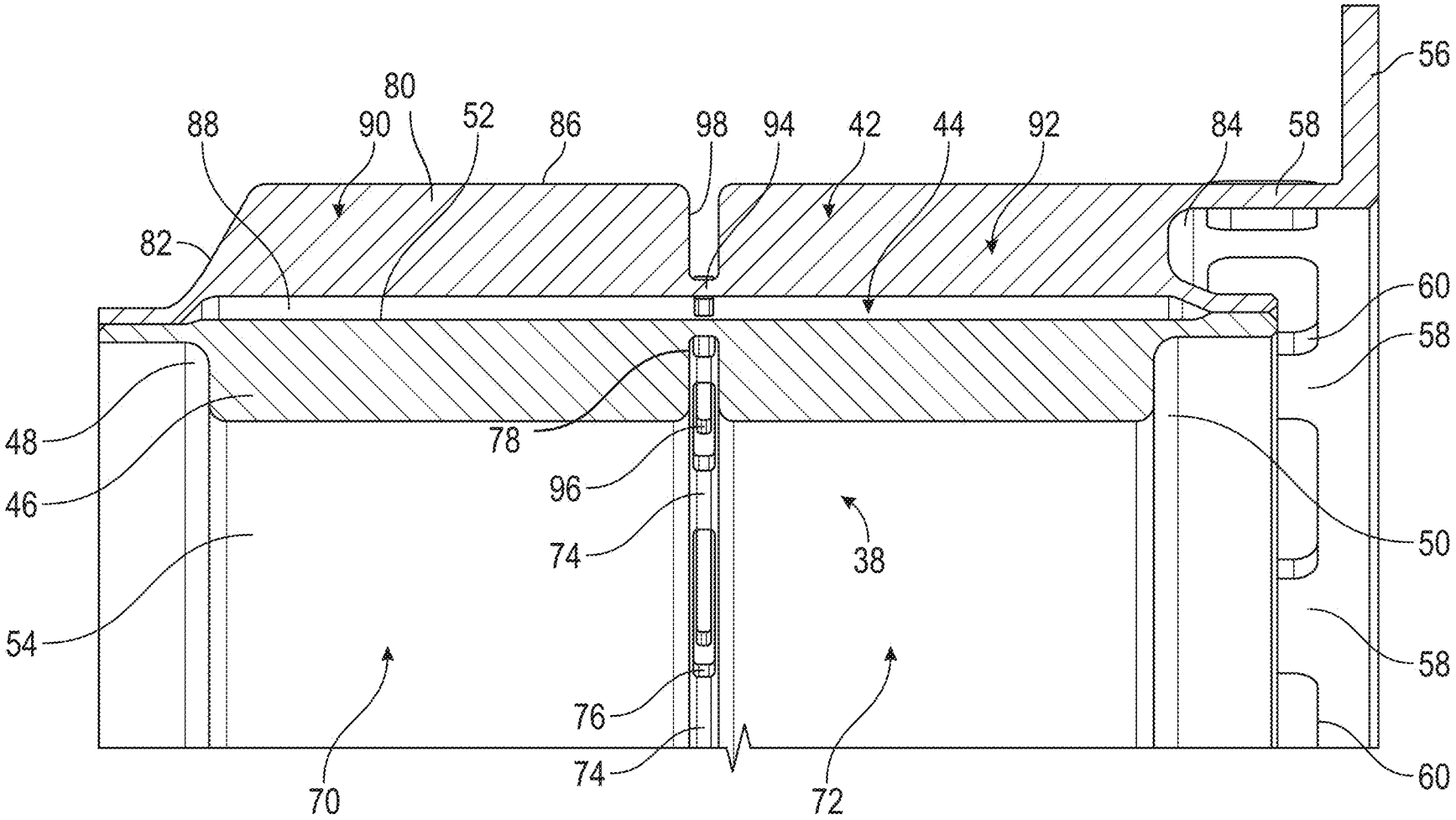
FIG. 4B is an enlarged perspective cross-sectional view of a portion of the containment ring in accordance with an alternative embodiment of the present disclosure.

In an alternative embodiment and referring now to at least FIGS. 4A and 4B, the flange portion 56 secured to the aft end 84 of the main body portion 80 of the second or outer containment ring 42 via a plurality of tabs 58 as opposed to the aft end 50 of the main body portion 46 of the first or inner containment ring 38. In this embodiment, the aft end 50 of the main body portion 46 of the first or inner containment ring 38 is secured to the aft end 84 of the main body portion 80 of the second or outer containment ring 42. As mentioned above the plurality of tabs 58 can be separated from each other by a plurality of openings 60 and the tabs 58 are configured to be frangible when the first or inner containment ring 38 is impacted with disc fragments during a fracture event. Still further and in one non-limiting embodiment with particular reference to this embodiment, the tabs 58 integrally formed with the second or outer containment ring 42 and the flange portion 56 so that they form a single unitary structure.

In addition and as illustrated in at least FIGS. 4A and 4B, the plurality of tabs 74 of the first or inner containment ring 38 are located at the outer periphery 52 of the main body portion 46 as opposed to the inner periphery 54 of the main body portion 46 and the plurality of tabs 94 of the second or outer containment ring 42 are located at the inner periphery 88 of the main body portion 80 as opposed to the outer periphery 86 of the main body portion 80. In addition, still other configurations of the tabs 74, 94 are considered to be within the scope of the present disclosure (e.g., tabs 94 at the outer periphery 86 and/or tabs 74 at the inner periphery 54 or vice versa). Note, the alternative configurations of the tabs 74 and 94 is not specifically limited to the configuration described above and illustrated in FIGS. 4A and 4B. In other words, the above described and illustrated configurations may be applied to the configuration illustrated in FIG. 4 (e.g., the flange portion 56 secured to the aft end 50 of the main body portion 46 of the first or inner containment ring 38). In other words, various embodiments of the present disclosure are considered to be applicable to any combinations of locations of the tabs 74, 94 and the flange portion 56.

Figure 5:
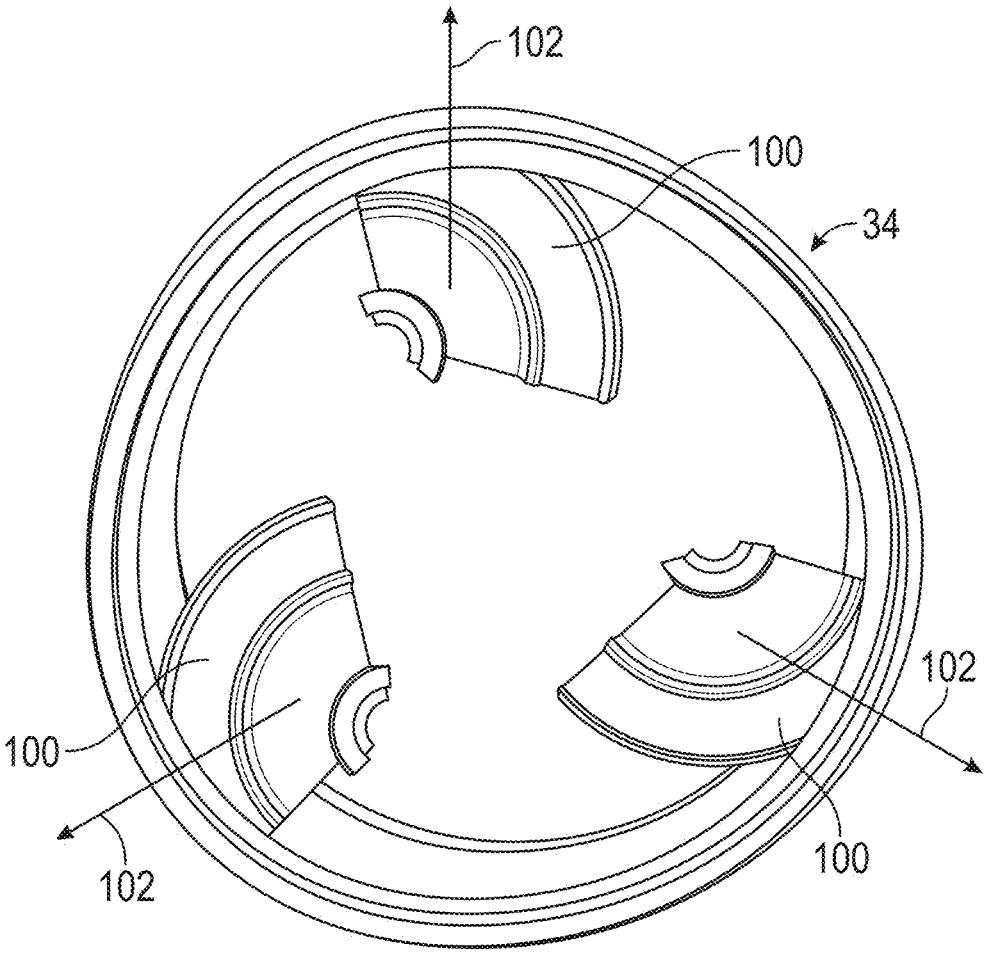
FIG. 5 is an illustration of containment of a rotor by the containment ring in accordance with the present disclosure.

Referring now to FIGS. 1-5, the first or inner containment ring 38 is designed to absorb the kinetic energy of disc fragments 100 in the direction of arrows 102 in the event of a tri-hub fracture event. For example, in the event the rotor 26 has separated into fragments 100 illustrated in FIG. 5. Note, the description of a tri-hub fracture event is merely provided as an example and various embodiments of the present disclosure are not limited to this specific event. FIG. 5 is an illustration of containment of portions or fragments of the rotor 26 by the containment ring or containment ring assembly 34 in accordance with the present disclosure.

For example and in an uncontrolled overspeed event, rotating parts (turbine discs, compressor rotor, impeller, etc.) can fracture in three parts (tri-hub) and the high energy fragments are contained by the containment ring or containment ring assembly 34. As such and in accordance with the present disclosure, these fragments 100 are contained using the containment ring or containment ring assembly 34 of the present disclosure.

The present disclosure is directed to a double layer containment ring architecture with a first layer that absorbs kinetic energy by plastic deformation and the second layer to contain the fragment in for example the aforementioned tri-hub fracture event.

By splitting the ring into two distinct containment zones, the first being the energy absorption zone where the fragment could deform severely the inner ring within the radial gap allowance, and the second zone (e.g., the outer ring) that will contain the fragment while keeping its integrity, preventing the fragment to pierce through. The gap 44 between the two layers or rings allows deformation of the ductile first containment ring 38.

The advantage of this concept is also that it allows varying the choices of materials for the inner and outer rings, by for example enabling a more ductile material for the first or inner containment ring 38, with the aim of increasing the deformation of the first containment ring 38 in the defined radial free zone between the two containment rings 38, 42.

The superposed rings 38, 42 concept enables the first ring 38 to absorb a small/narrower point of impact, and by its design allows greater deformation than a thicker single ring containment assembly. This deformation results in a considerably larger contact area in the second ring 42, which distributes the impact load and enables containment with efficiently sized containment rings. In addition and by implementing two containment rings 38 and 42 with a radial gap 44, the overall weight of the containment assembly 34 can be reduced which is, of course, desirable in a gas turbine engine 10.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A containment ring assembly for a turbine casing assembly, comprising:

a first containment ring, the first containment ring having a main body portion, the main body portion of the first containment ring having a forward end and an aft end, an outer periphery, and an inner periphery, the main body portion of the first containment ring has: a first stage containment zone and a second stage containment zone, the first stage containment zone comprising a ring of material coupled to a ring of material comprising the second stage containment zone by a plurality of tabs, the plurality of tabs being separated from each other by a plurality of slotted openings and the plurality of slotted openings being in fluid communication with an annular groove that extends from the outer periphery of the main body portion of the first containment ring; and a second containment ring, the first containment ring being radially inward from the second containment ring, wherein a radial space is located between portions of the first containment ring and the second containment ring, the radial space allowing deformation of the portions of the first containment ring prior to the portions of the first containment ring contacting the second containment ring, the second containment ring having a main body portion, the main body portion of the second containment ring having a forward end and an aft end, an outer periphery, and an inner periphery, and the radial space is located between the outer periphery of the first containment ring and the inner periphery of the second containment ring, the main body portion of the second containment ring has: a first stage containment zone and a second stage containment zone, the first stage containment zone comprising a ring of material coupled to a ring of material comprising the second stage containment zone by a plurality of tabs, the plurality of tabs being separated from each other by a plurality of slotted openings and the plurality of slotted openings being in fluid communication with an annular groove that extends from the inner periphery of the main body portion of the second containment ring.

2. The containment ring assembly as in claim 1, wherein the first containment ring and the second containment ring are formed from two different types of material.

3. The containment ring assembly as in claim 1, wherein the first containment ring is formed from a more ductile material than the second containment ring.

4. The containment ring assembly as in claim 1, further comprising a flange portion secured to the aft end of the main body portion of the first containment ring or the aft end of the main body portion of the second containment ring.

5. The containment ring assembly as in claim 4, wherein the forward end of the main body portion of the first containment ring is secured to the forward end of the main body portion of the second containment ring.

6. The containment ring assembly as in claim 5, wherein the flange portion is secured to the aft end of the main body portion of the first containment ring or the aft end of the main body portion of the second containment ring by a plurality of tabs extending between the flange portion and the aft end of the main body portion of the first containment ring or the aft end of the main body portion of the second containment ring.

7. The containment ring assembly as in claim 6, wherein the first containment ring and the second containment ring are formed from two different types of material.

8. The containment ring assembly as in claim 6, wherein the first containment ring is formed from a more ductile material than the second containment ring.

9. A turbine casing assembly, comprising:

an outer structural case; and a containment ring, comprising:

a first containment ring, the first containment ring having a main body portion, the main body portion of the first containment ring having a forward end and an aft end, an outer periphery, and an inner periphery, the main body portion of the first containment ring has: a first stage containment zone and a second stage containment zone, the first stage containment zone comprising a ring of material coupled to a ring of material comprising the second stage containment zone by a plurality of tabs, the plurality of tabs being separated from each other by a plurality of slotted openings and the plurality of slotted openings being in fluid communication with an annular groove that extends from the outer periphery of the main body portion of the first containment ring; and a second containment ring, the first containment ring being radially inward from the second containment ring, wherein a radial space is located between portions of the first containment ring and the second containment ring, the radial space allowing deformation of the portions of the first containment ring prior to the portions of the first containment ring contacting the second containment ring, the second containment ring having a main body portion, the main body portion of the second containment ring having a forward end and an aft end, an outer periphery, and an inner periphery, and the radial space is located between the outer periphery of the first containment ring and the inner periphery of the second containment ring, the main body portion of the second containment ring has: a first stage containment zone and a second stage containment zone, the first stage containment zone comprising a ring of material coupled to a ring of material comprising the second stage containment zone by a plurality of tabs, the plurality of tabs being separated from each other by a plurality of slotted openings and the plurality of slotted openings being in fluid communication with an annular groove that extends from the inner periphery of the main body portion of the second containment ring.

10. The turbine casing assembly as in claim 9, wherein the first containment ring and the second containment ring are formed from two different types of material.

11. The turbine casing assembly as in claim 9, wherein the first containment ring is formed from a more ductile material than the second containment ring.

12. The turbine casing assembly as in claim 9, further comprising a flange portion secured to the aft end of the main body portion of the first containment ring or the aft end of the main body portion of the second containment ring, the flange portion being secured to the outer structural case.

13. The outer structural case as in claim 12, wherein the forward end of the main body portion of the first containment ring is secured to the forward end of the main body portion of the second containment ring.

14. The outer structural case as in claim 13, wherein the flange portion is secured to the aft end of the main body portion of the first containment ring or the aft end of the main body portion of the second containment ring by a plurality of tabs extending between the flange portion and the aft end of the main body portion of the first containment ring or the aft end of the main body portion of the second containment ring.

15. The outer structural case as in claim 14, wherein the first containment ring and the second containment ring are formed from two different types of material and the first containment ring is formed from a more ductile material than the second containment ring.

16. A gas turbine engine, comprising:

a compressor section;

a combustor;

a turbine section; and a turbine casing assembly, the turbine casing assembly comprising:

an outer structural case; and a containment ring, the containment ring comprising:

a first containment ring, the first containment ring having a main body portion, the main body portion of the first containment ring having a forward end and an aft end, an outer periphery, and an inner periphery, the main body portion of the first containment ring has: a first stage containment zone and a second stage containment zone, the first stage containment zone comprising a ring of material coupled to a ring of material comprising the second stage containment zone by a plurality of tabs, the plurality of tabs being separated from each other by a plurality of slotted openings and the plurality of slotted openings being in fluid communication with an annular groove that extends from the outer periphery of the main body portion of the first containment ring; and a second containment ring, the first containment ring being radially inward from the second containment ring, wherein a radial space is located between portions of the first containment ring and the second containment ring, the radial space allowing deformation of the portions of the first containment ring prior to the portions of the first containment ring contacting the second containment ring, the second containment ring having a main body portion, the main body portion of the second containment ring having a forward end and an aft end, an outer periphery, and an inner periphery, and the radial space is located between the outer periphery of the first containment ring and the inner periphery of the second containment ring, the main body portion of the second containment ring has: a first stage containment zone and a second stage containment zone, the first stage containment zone comprising a ring of material coupled to a ring of material comprising the second stage containment zone by a plurality of tabs, the plurality of tabs being separated from each other by a plurality of slotted openings and the plurality of slotted openings being in fluid communication with an annular groove that extends from the inner periphery of the main body portion of the second containment ring.

* * * * *